United States Patent [19]

Thackeray

[11] Patent Number: 4,904,195

[45] Date of Patent: Feb. 27, 1990

[54] TWIST-LOCK FEMALE-MALE PLUG ADAPTER

[76] Inventor: Michael Thackeray, 2380 Stafford Rd., Thousand Oaks, Calif. 91361

[21] Appl. No.: 210,867

[22] Filed: Jun. 24, 1988

[51] Int. Cl.[4] ..... H01R 29/00; H01R 31/06

[52] U.S. Cl. ..... 439/173; 439/166; 439/176; 439/628

[58] Field of Search ..... 439/166, 167, 170–176, 439/247, 628

[56] References Cited

U.S. PATENT DOCUMENTS 2,957,156 10/1960 Gatto et al. ..... 439/166
4,010,993 3/1977 Hohenberger et al. ..... 439/176
4,232,260 11/1980 Lambkin ..... 439/173
4,585,286 4/1986 Parr ..... 439/173
4,726,780 2/1988 Thackeray ..... 439/223

*Primary Examiner*—P. Austin Bradley
*Attorney, Agent, or Firm*—Milton S. Gerstein

[57] ABSTRACT

An auxiliary male twist-lock plug-adapter for converting a female twist-lock plug-adapter to male. The male adapter is a disc defining an upper and a lower face. Three twist-lock electrode-prongs project from the upper surface, and three conventional electrode-prongs project from the lower surface. Either of the two sets of three prongs may be coupled to the female twist-lock plug adapter so that the other, uncoupled set may be connected to a conventional female plug or to another female twist-lock plug adapter.

17 Claims, 3 Drawing Sheets

TWIST-LOCK FEMALE-MALE PLUG ADAPTER

BACKGROUND OF THE INVENTION

The present invention is directed to a female-male plug adapter for twist-lock electrical cords. In applicant's U.S. Pat. No. 4,726,780, there is disclosed a female twist-lock adapter for an extension cord that allows for the male plug-end of a twist-lock cord to be plugged in so that the other end of the adapter may be plugged into a power outlet, and also allows for the reception of a conventional two-electrode male plug and a conventional three-electrode male plug where one is ground.

SUMMARY OF THE INVENTION

It is the primary objective of the present invention to provide an auxiliary male adapter for the female twist-lock adapter cord shown in U.S. Pat. No. 4,726,780, such that the female adapter thereof may be easily and readily converted to a male plug end for subsequent coupling into another conventional extension cord or, in the non-twist-lock state thereof, directly into a power outlet.

It is another object of the present invention to provide such an auxiliary male-plug adapter for twist-lock plugs such that such auxiliary male adapter is readily coupled into the female lug adapter of U.S. Pat. No. 4,726,780. It is still another objective of the present invention to provide such an auxiliary male plug adapter that offers further connection to a twist-lock type of female plug or to a conventional female plug having three terminals one of which is ground.

It is yet another objective of the present invention to provide a combination of female twist-lock adapter shown in said patent and an auxiliary male plug adapter of the present invention in order to allow for any number of extension cords to be used at a construction site, and the like, where the distance to a power outlet is far, to thereby couple a power-consuming device or tool to a power outlet, such connection only depending upon the number of such cords to be used.

Toward these and other ends, the auxiliary male plug adapter of the present invention is provided with an insulating mounting plate defining a first, upper, flat surface face and a second, lower, flat surface face. Projecting outwardly from the first surface face are three male electrodes of a twist-lock type of plug, and projecting from the second surface face are three male electrodes of a conventional three-prong male plug, one being ground. This auxiliary male adapter is used in combination with the twist-lock female plug adapter of U.S. Pat. No. 4,726,780, by which either one of the two sets of prongs may be received in the female plug adapter shown in said patent, to thereby provide a male plug adapter having the other one of the two sets of prongs as the male electrodes thereof for subsequent connection to a mating female plug or to another female twist-lock adapter of said patent. Since the female twist-lock adapter of said patent will readily accomodate male twist-lock plugs, conventional three-prong plugs, and conventional two-prong plugs, the auxiliary male adapter of the present invention may be provided with any two sets of these three types of male plug-ends, whereby any type of female plug-receptacle or female plug end of an extension cord may be accomodated and coupled to the female twist-lock plug adapter of said patent through the auxiliary male adapter of the present invention. The auxiliary plug adapter is housed along with the female twist-lock adapter in a casing allowing for the ready and easy insertion and removal of the parts therein, so that the auxiliary male adapter of the invention may be readily replaced, so that the female twist-lock adapter of said patent may be readily retrofitted with the auxiliary male adapter of the invention, and so that a different auxiliary male adapter of the invention may be used whether of the same type or of a different type where one of the sets on one of the surface faces thereof is different from that of the one being replaced.

BRIEF DESCRIPTION OF THE DRAWING

The invention will be more readily understood with reference to the accompany drawing, wherein.

DETAILED DESCRIPTION OF THE INVENTION

Figure 1:
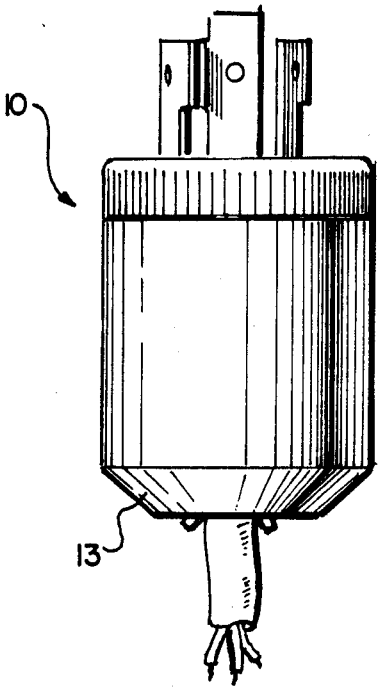
FIG. 1 is an isometric view showing the auxiliary male plug adapter of the invention mounted in a housing to provide a complete unit in combination with a female twist-lock plug adapter.
Figure 4:
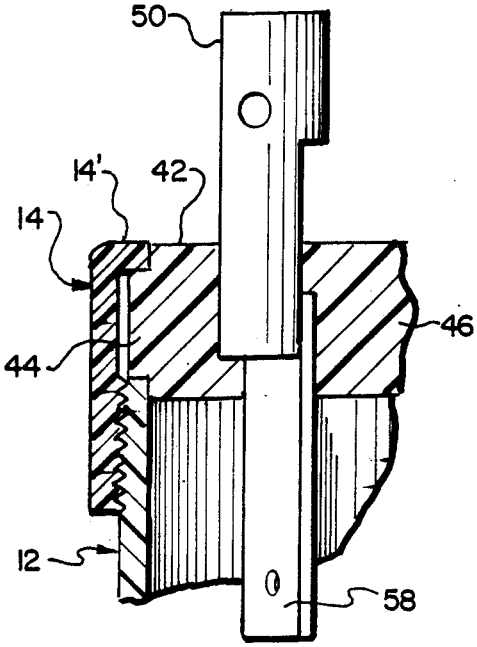
FIG. 4 is a cross-sectional view taken along line 4—4 of FIG. 2.
Figure 2:
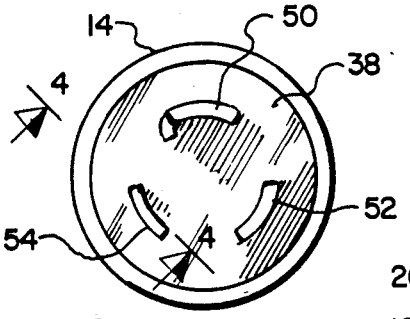
FIG. 2 is a top view thereof.
Figure 3:
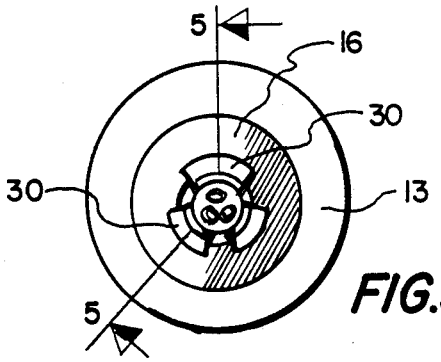
FIG. 3 is a bottom view thereof.
Figure 5:
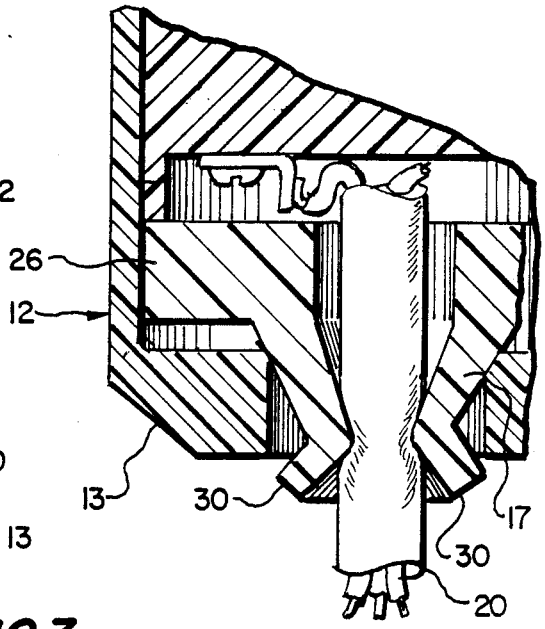
FIG. 5 is a cross-sectional view taken along line 5—5 of FIG. 3.
Figure 6:
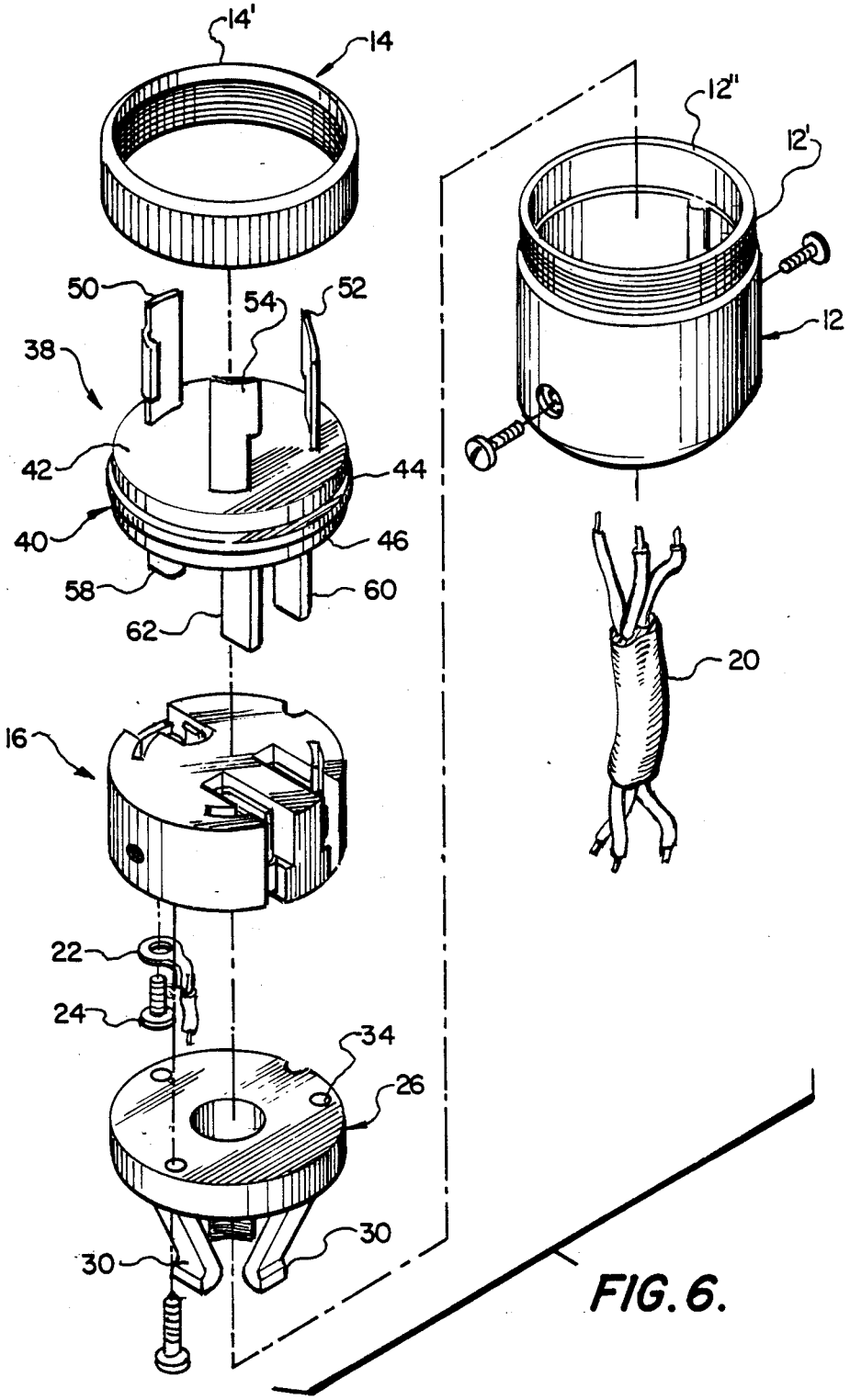
FIG. 6 is an assembly view, in isometric, showing the arrangement of parts of the combination of auxiliary male plug adapter and female twist-lock adapter to form the completed unit shown in FIG. 1.

Referring now to the drawings in greater detail, FIG. 1 shows a complete unit 10 according to the present invention which has been converted to a male adapter. The unit 10 is best seen in FIG. 6, and includes an outer main housing or frame 12 for mounting and assembling the parts therein. This housing is a substantially hollow cylinder and has an upper end 12' formed as a threaded, recessed annular region which mates with a closure cap 14 also of hollow cylindrical shape having interior threads mating with the threads of the upper end 12' to close off the parts within the cavity of the housing 12. Mounted within the housing 12 is a female twist-lock plug adapter 16 disclosed and claimed in applicant's U.S. Pat. No. 4,726,780. Such female adapter may be that shown in FIG. 6, or alternatively may be the female adapter 16' shown in FIG. 12, both of which are disclosed in said patent. An electrical cord 20 extends into the hollow interior of the housing 12 with the conductors thereof secured to the respective terminals of the female adapter 16 via rings 22 and screws 24 as set forth in said patent. The cord 20 first passes through a lower clamping plate 26 having a central hole. The clamping plate is provided with three flexible fingers 30 which grip and hold the cord 20 therebetween, in the manner best seen in FIGS. 3, 5 and 11. These fingers 30 are urged toward each other by the frustro-conical shaped lower section 13 seen in FIGS. 1 and 5, which defines a bottom hole for the passage of the cord 20. These fingers 30 are urged interiorly by an annular camming surface 17 thereof. The clamping plate 26 is secured to the underside of the female adapter 16 via screws passing through holes 34 in the clamping plate, which screws are received in corresponding aligned holes in the undersurface of the female adapter 16. According to the present invention, the female, twist-lock plug adapter of said patent is converted to a male twist-lock plug adapter via an auxiliary male plug adapter 38. This male adapter 38 includes a main mounting disc 40 formed generally into into three circular sections: A first upper section 42, a second intermediate section 44, and a third lower section 46. These sections are also seen in FIG. 4. The three parts are formed of one integral piece, with the intermediate or center section 44 having a greater diameter than the other sections, so as to form a lower beaded or projecting circumferential rim which rests or is supported upon the upper circular edge surface 12" of the upper end 12' of the housing 12, as shown in detail in FIG. 4. There is also formed an upper beaded or projecting rim upon which rests upper, inwardly-inturned circular beaded portion 14' of the cover plate 14, whereby during threaded securing, the male adapter 38 is securely held in place on the housing via the closure plate 14, in the manner shown in FIG. 4. This arrangement provides for easy removal and replacement of the male adapter 38, as described below.

The auxiliary male adapter 38 is provided with two sets of three male electrodes. The first set projects upwardly from the upper surface of the upper section 42 thereof, while the second set projects downwardly from the lower surface of the lower section 46. The first set has male electrodes 50, 52, 54 constituting the male electrodes of a male twist-lock plug, with the electrode 50 being ground, and the electrodes 52 and 54 being power and neutral, respectively. This first set projects through the hollow interior of the cover plate 14 and therebeyond, in the manner shown in FIG. 1, to thereby establish a male plug for subsequent connection to a female plug-end of conventional twist-lock extension cord or to a female twist-lock adapter 16 forming the female end of an extension cord in accordance with U.S. Pat. No. 4,726,780. The second set consists of electrodes 58, 60, 62 which are those electrodes of a conventional three-prong male plug, with the prong 58 being ground and the prongs 60, 62 being power and neutral, respectively. The set of electrodes are received in the terminals of the female plug adapter 16, in the manner disclosed in said patent. Thus, it may be seen that the female adapter 16 is readily transformable into a male adapter via the auxiliary male adapter 38. If it is desired to connect the cord 20 to another extension cord having a female plug-end of the non-twist-lock type, but one of conventional type corresponding to the male prongs 58, 60, 62, one simply everts the auxiliary male adapter 38 after having removed the cover plate 14, so that the first set of prongs 50, 52, 54 are inserted into the terminals of the female adapter 16, in the manner disclosed in said patent, whereby the second set of prongs 58, 60, 62 now are available for connection to the conventional female plug-end of another extension cord, after the cover plate 14 has again been replaced. The adapter 38 may also have instead of the second set of prongs 58, 60, 62, just two prongs of a conventional household male plug, where no ground prong is provided. Alternatively, the first set of electrodes 50, 52, 54 may be replaced with two prongs of the conventional household male plug, with the second set 58, 60, 62 being as shown in FIG. 6.

Figure 7:
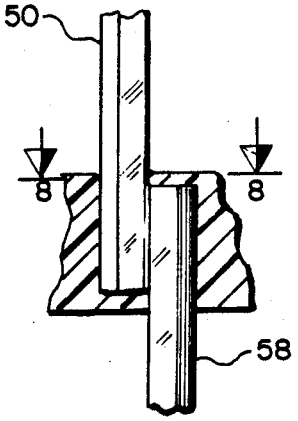
FIG. 7 is a detail view, in side elevation, showing the connection between each male electrode projecting from a first face of the male adapter of the invention and a corresponding male electrode projecting from the other face of the male adapter.
Figure 9:
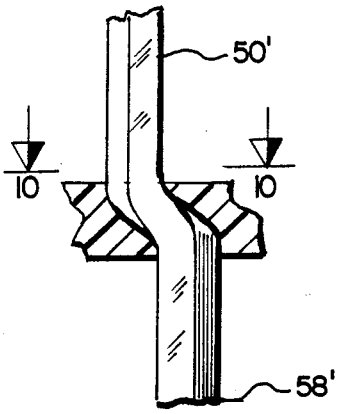
FIG. 9 is a detail view, in side elevation, showing an alternative embodiment of the connection between each male electrode projecting from a first face of the male adapter of the invention and a corresponding male electrode projecting from the other face of the male adapter.
Figure 8:
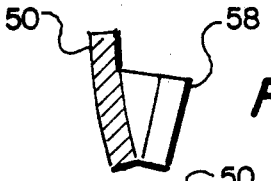
FIG. 8 is a cross-sectional view taken along line 8—8 of FIG. 7.
Figure 10:
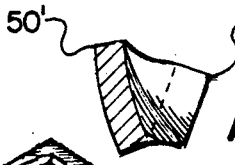
FIG. 10 is a cross-sectional view taken along line 10—10 of FIG. 9.
Figure 11:
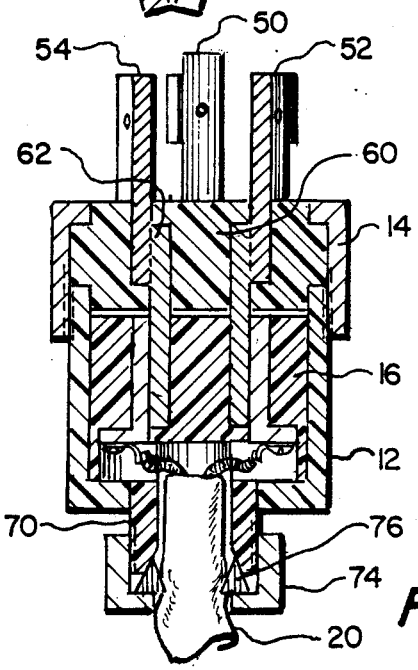
FIG. 11 is a longitudinal cross-sectional view of the complete unit of FIG. 1.
Figure 12:
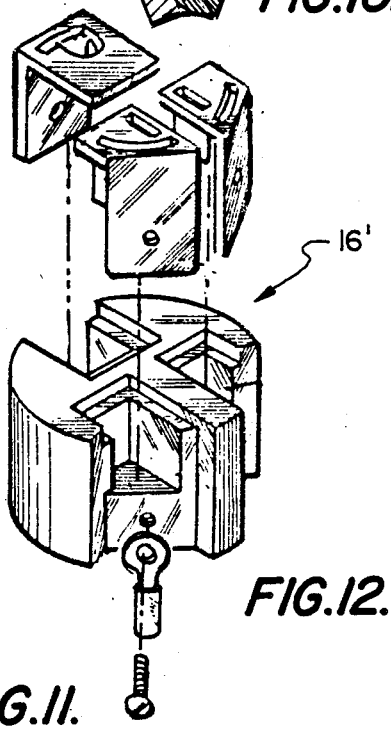
FIG. 12 is an isometric view showing a modified female twist-lock adapter that may be used in combination with the male adapter of the present invention.

In the preferred form of the invention, each prong of the first set is joined or formed integrally with the corresponding prong or electrode of the second set as shown in FIGS. 4, 7,8 and 11. Referring to FIGS. 7 and 8, the electrode 50 of the first set overlaps and is joined to the electrode 58 of the second set. The electrodes 52 and 54 of the first set are similarly connected to the electrodes 60, 62, respectively, of the second set. FIGS. 9 and 10 show a modification in that the corresponding electrodes 50' and 58' are actually formed from one piece of formed metal, with a transitional region 51 therebetween defining the transition from the prong 50' of the first set to the prong 58' of the second set. FIG. 11 shows an alternative structure to the clamping plate 26. In this modification, the lower end of the housing 12 is provided with a downwardly extending tubular section 70 through which passes the cord 20, with a closure cap 74 threadingly closing off the lower end of the tubular section 70. The cap 74 has an upwardly projecting camming surface 76 that defines an outer sloped surface that cooperates with a similar interior sloped surface of the tubular section, the camming surface also defining an inner sloped surfaces that snugly pinches a portion of the cord 20 thereat, as shown in FIG. 11. In the preferred embodiment of FIG. 6, when the lower frustro-conical section 13 is not provided, there are provided securing holes in the housing 12 which receive securing screws therethrough for contact against the outer surface of the female adapter 16, so that when the male adapter portion 38 is removed, the female adapter and other parts attached thereto in the housing do not fall out of the housing. In the modification of FIG. 11, the parts are prevented from falling out by the bottom closure cap 74.

While a specific embodiment of the invention has been shown and described, it is to be understood that numerous changes and modifications may be made therein without departing from the scope, spirit and intent of the invention as set forth in the appended claims.

What I claim is:

1. An auxiliary male plug-adapter for a female twist-lock plug adapter, comprising:

a mounting frame means, said frame means defining an upper surface face and a lower surface face;

a first set of three arcuately spaced-apart male electrode prongs projecting outwardly from said upper face of said frame means;

a second set of at least two spaced-apart male electrode prongs projecting from said lower surface face, whereby either of said first and second sets may be coupled to a female twist-lock plug adapter for subsequent connection of the free set to another female plug;

each said prong of said second set being electrically coupled to one respective said prong of said first set;

a first female, twist-lock plug means comprising three terminal means for selectively receiving therein the prongs of said first and second sets;

means for housing said female plug means and said frame means together to form one complete unit, said twist-lock plug means also comprising cord means comprising a plurality of conductors and having an end thereof electrically coupled to said three terminal means, one of said first and second sets of prongs being received in said female twist-lock plug means, each said terminal means of said twist-lock plug means comprising means for electrically connecting a respective conductor of said cord means thereto;

and a second female plug means different from said first plug means in which is received said other of said first and second sets of prongs when said one set is received in said first plug means.

2. The device according to claim 1, further comprising means for securing said end of said cord means to said means for housing for preventing relative movement between said end of said cord means and said means for housing, whereby the chances of accidental removal of said cord end from said terminals are reduced.

3. The auxiliary male plug-adapter according to claim 1, wherein said second set comprises two said male electrode-prongs defining the prongs of a standard household male plug.

4. The auxiliary male plug-adapter according to claim 3, wherein said second set comprises three said male electrode-prongs defining the prongs of a three-prong household male plug, one said prong being ground, one said prong being neutral, and one said prong being power.

5. The auxiliary male plug-adapter according to claim 4, wherein said first set comprises three said male electrode-prongs defining the prongs of a three-prong twist-lock male plug, one said prong being ground, one said prong being neutral, and one said prong being power.

6. The auxiliary male plug-adapter according to claim 5, wherein said each said prong of said first set is connected to a corresponding said prong of said second set, such that said neutral prongs are connected together, said power prongs are connected together, and said ground prongs are connected together.

7. The auxiliary male plug-adapter according to claim 6, wherein said frame means comprises a disc defining said upper and lower faces thereof; said disc comprising three through-openings for the passage therethrough of said connected pairs of corresponding prongs.

8. The auxiliary male plug-adapter according to claim 1, wherein said means for housing comprises a hollow cylindrical housing having an upper threaded end defining an upper edge surface thereof, and a threaded closure plate; said frame means comprises a central circumferential projecting rim for support upon said upper edge surface, said closure surrounding said central projecting rim and having an upper interior annular portion bearing against an outer circumferential portion of said upper surface of said frame means, whereby said closure plate secures said frame means to said cylindrical housing.

9. The auxiliary male plug-adapter according to claim 8, wherein said second set comprises three said male electrode-prongs defining the prongs of a three-prong household male plug, one said prong being ground, one said prong being neutral, and one said prong being power.

10. The auxiliary male plug-adapter according to claim 9, wherein said first set comprises three said male electrode-prongs defining the prongs of a three-prong twist-lock male plug, one said prong being ground, one said prong being neutral, and one said prong being power.

11. The auxiliary male plug-adapter according to claim 10, wherein said each said prong of said first set is connected to a corresponding said prong of said second set, such that said neutral prongs are connected together, said power prongs are connected together, and said ground prongs are connected together.

12. An auxiliary male plug-adapter for a female twist-lock plug adapter, comprising:

a mounting frame means, said frame means defining an upper surface face and a lower surface face;

a first set of three arcuately spaced-apart male electrode prongs projecting outwardly from said upper face of said frame means;

a second set of at least two spaced-apart male electrode prongs projecting from said lower surface face, whereby either of said first and second sets may be coupled to a female twist-lock plug adapter for subsequent connection of the free set to another female plug;

a female, twist-lock plug-adapter comprising three terminal means for receiving therein the prongs of said first and second set, and means for housing said female adapter and said auxiliary male adapter together to form one complete unit;

said means for housing comprises a hollow housing having an upper threaded end defining an upper edge surface thereof, and a threaded closure plate; said frame means comprises a middle projecting rim for support upon said upper edge surface, said closure plate surrounding at least a section of said projecting rim and having an interior-extending rib portion bearing against an upper part of said frame means, whereby said closure plate secures said frame means to said cylindrical housing.

13. The auxiliary male plug-adapter according to claim 12, wherein said second set comprises three said male electrode-prongs defining the prongs of a three-prong household male plug, one said prong being ground, one said prong being neutral, and one said prong being power; said first set comprising three said male electrode-prongs defining the prongs of a three-prong twist-lock male plug, one said prong being ground, one said prong being neutral, and one said prong being power; said each said prong of said first set being connected to a corresponding said prong of said second set, such that said netural prongs are connected together, said power prongs are connected together, and said ground prongs are connected together; said frame means comprising a disc defining said upper and lower faces thereof; said disc comprising three through-openings for the passage therethrough of said connected pairs of corresponding prongs.

14. An auxiliary male plug-adapter for a female twist-lock plug adapter, comprising:

a mounting frame means, said frame means defining an upper surface face and a lower surface face;

a first set of three arcuately spaced-apart male electrode prongs projecting outwardly from said upper face of said frame means;

a second set of at least two spaced-apart male electrode prongs projecting from said lower surface face, whereby either of said first and second sets may be coupled to a female twist-lock plug adapter for subsequent connection of the free set to another female plug;

each said prong of said second set being electrically coupled to one respective said prong of said first set;

a female, twist-lock plug means comprising three terminal means for selectively receiving therein the prongs of said first and second sets;

means for housing said female plug means and said frame means together to form one complete unit, said twist-lock plug means also comprising cord means comprising a plurality of conductors and having an end thereof electrically coupled to said three terminal means, one of said first and second sets of prongs being received in said female twist-lock plug means, each said terminal means of said twist-lock plug means comprising means for electrically connecting a respective conductor of said cord means thereto;

said means for housing comprising a hollow interior for mounting said female twist-lock plug means and said frame means therein, and having an open upper end, the other of said first and second sets of prongs projecting through said open upper end and therebeyond for subsequent connection to another female plug means while said one set is received in said female twist-lock plug means.

15. The device according to claim 14, further comprising another female plug means, said other set of said first and second sets of prongs being connected to said another female plug means.

16. The device according to claim 15, further comprising means for securing said end of said cord means to said means for housing for preventing relative movement between said end of said cord means and said means for housing, whereby the chances of accidental removal of said cord end from said terminals are reduced.

17. The device according to claim 16, wherein said means for housing further comprises an open lower opening through which extends said end of said cord means for coupling to said three terminal means.

* * * * *